US005934037A

United States Patent [19]

Bundra

[11] Patent Number: 5,934,037

[45] Date of Patent: Aug. 10, 1999

[54] BUILDING BLOCK

[76] Inventor: Octavian Bundra, 16 Forte Ave., Medford, N.Y. 11763

[21] Appl. No.: 08/996,332

[22] Filed: Dec. 22, 1997

[51] Int. Cl.[6] ..... E04B 5/04

[52] U.S. Cl. ..... 52/603; 52/220.2; 52/126.4; 52/592.6; 52/306

[58] Field of Search ..... 52/603, 220.2, 52/126.4, 592.6, 306

[56] References Cited

U.S. PATENT DOCUMENTS

| | | | |
|---|---|---|---|
| 2,281,524 | 11/1942 | Meyers | 72/42 |
| 4,124,961 | 11/1978 | Habegger | 52/592 |
| 4,297,816 | 11/1981 | Kella et al. | 52/125 |
| 4,965,979 | 10/1990 | Larrives et al. | 52/585 |
| 5,230,195 | 7/1993 | Sease . | |
| 5,365,714 | 11/1994 | Potvin . | |
| 5,471,808 | 12/1995 | DePieri et al. . | |
| 5,505,034 | 4/1996 | Dueck . | |
| 5,647,185 | 7/1997 | Forlini | 52/604 |

*Primary Examiner*—Carl D. Friedman
*Assistant Examiner*—Nkeisha J Maddox
*Attorney, Agent, or Firm*—Michael I Kroll

[57] ABSTRACT

An improved building block (12) for constructing an exterior wall (14) comprising a solid body (16) having a front face (18), a rear face (20), two end faces (22), a top face (24) and a bottom face (26). A plurality of alignment projections (28) are on the top face (24) of the solid body (16). The bottom face (26) of the solid body (16) has a plurality of alignment sockets (30) therein. When a plurality of the solid bodies (16) are laid side by side and are stacked offset one upon the other to make a plurality of courses (32), the alignment projections (28) will engage with the alignment sockets (30) to form equally spaced joints (34) therebetween to be filled in later with mortar (36), to construct the exterior wall (14).

22 Claims, 4 Drawing Sheets

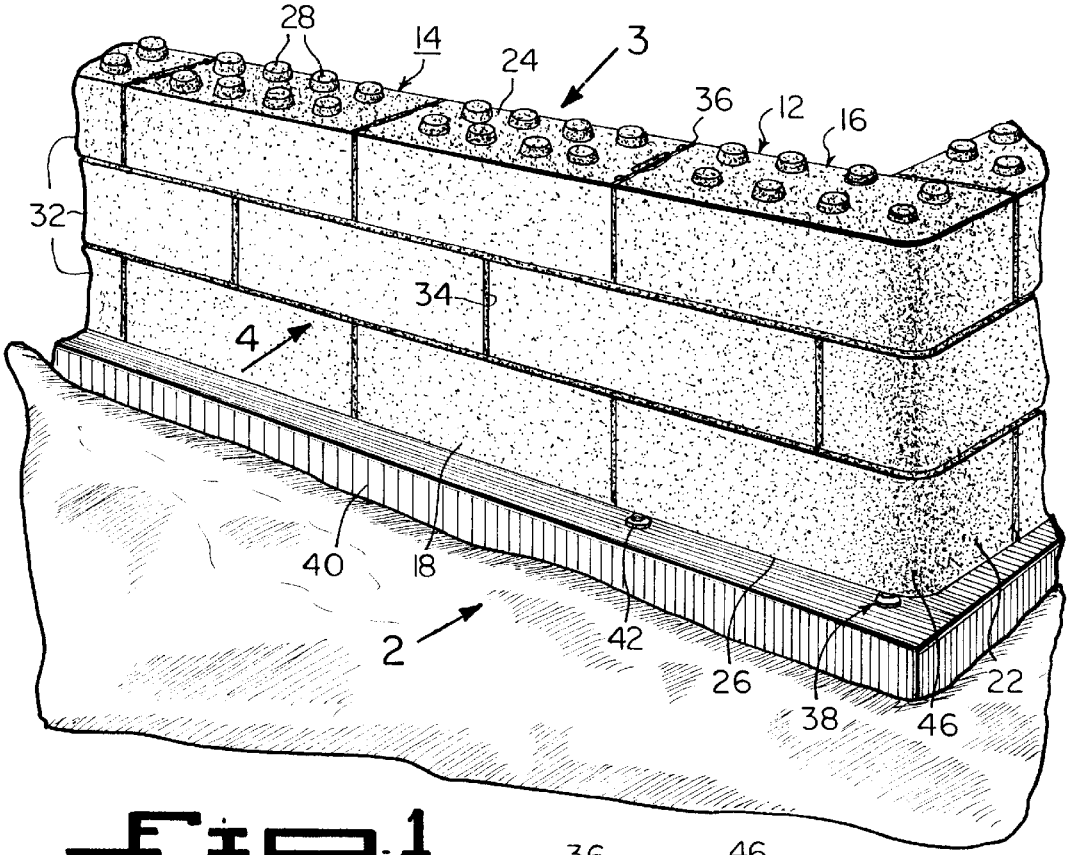
Fig. 1
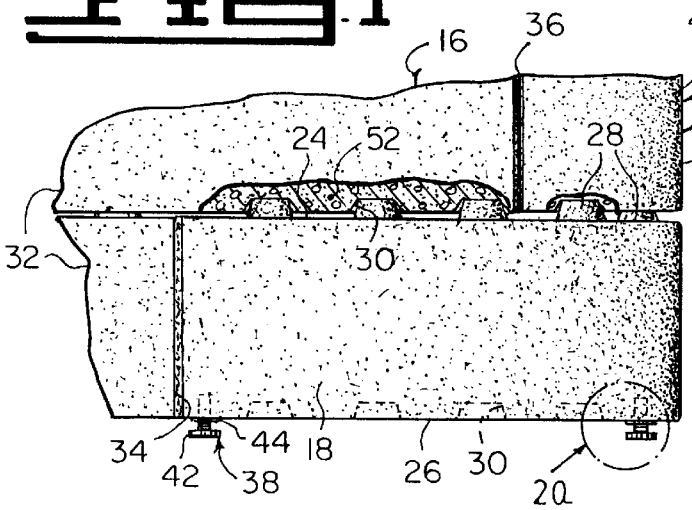
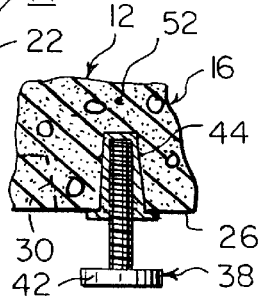
Fig. 2a
Fig. 2

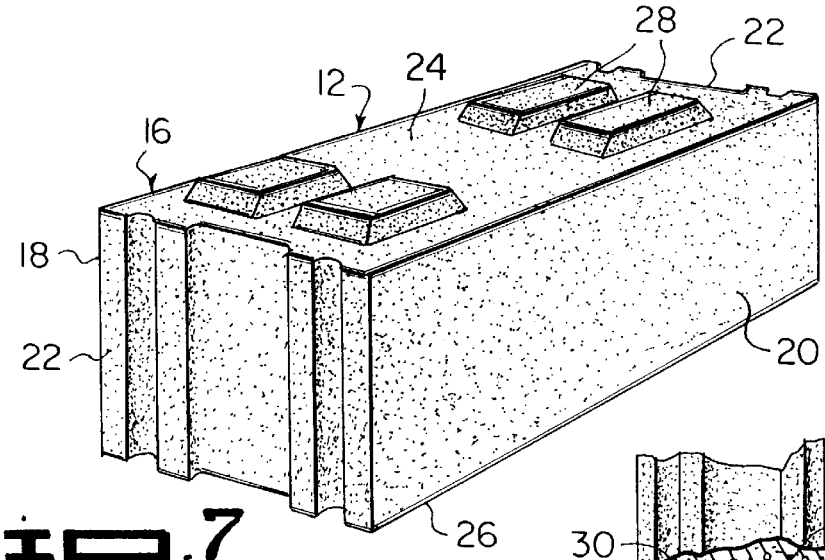
Fig. 7
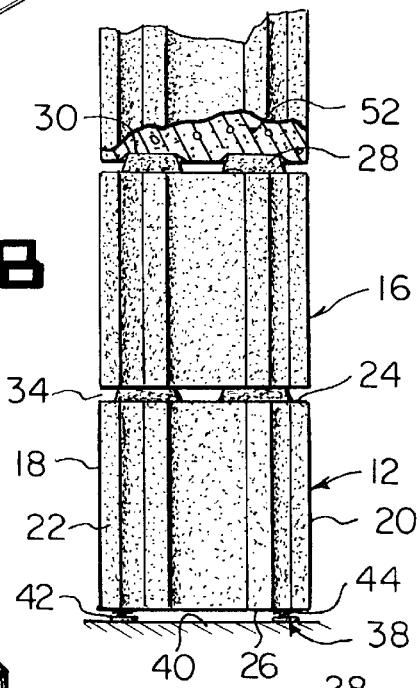
Fig. 8
Fig. 9
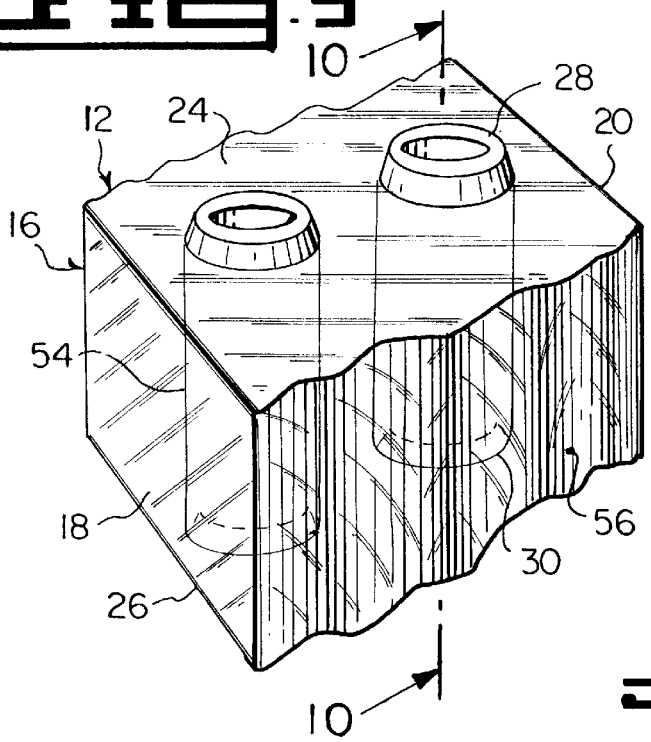
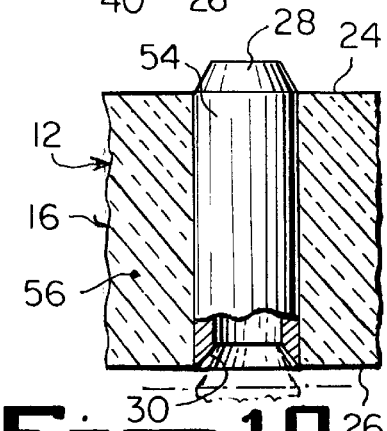
Fig. 10

BUILDING BLOCK

BACKGROUND OF THE INVENTION

1. Field of the Invention

The instant invention relates generally to construction materials and more specifically it relates to an improved building block. The improved building block provides a much faster installation, with less skill necessary for construction of an exterior wall, since the building blocks will also be set with equally spaced joints therebetween by mating projections and recesses between the building blocks. The mason can stack more courses without settling and does not have to put a level on every building block during the construction of the exterior wall. The lowest course of building blocks are leveled on a support foundation with adjustment feet.

2. Description of the Prior Art

Numerous construction materials have been provided in prior art. For example, U.S. Pat. Nos. 5,230,195 to Sease; 5,365,714 to Potvin; 5,471,808 to DePieri et al. and 5,505,034 to Dueck all are illustrative of such prior art. While these units may be suitable for the particular purpose to which they address, they would not be as suitable for the purposes of the present invention as heretofore described.

SEASE, STANLEY, R.

INSULATING MOLDED PLASTIC BUILDING UNIT

U.S. Pat. No. 5,230,195

An insulating molded plastic building unit comprises a rectangular parallelepiped without a rear wall. One or more alignment bosses extending upwardly and outwardly from an upper wall of the building unit are equidistantly spaced from a front face and a side face thereof to cooperatively align with alignment sockets of automatically space superimposed building units. Each building unit has vertical and diagonal webs for structural reinforcement thereof. Cavities within each building unit can be filled with insulating material to enhance the insulating characteristics thereof. A plurality of the building units are laid in courses with joints formed therebetween with waterproof adhesive.

POTVIN, RICARDO

SAWDUST BUILDING BLOCKS ASSEMBLY

U.S. Pat. No. 5,365,714

A wall for a rampart or building, consisting of a plurality of building blocks, each comprising slightly compacted sawdust or wood chips glued with resin. The building blocks are interconnected by a number of assembling pins and by recesses integral to the respective blocks, so as to frictionally engage into one another. There are also provided full length projections and corresponding grooves of the respective blocks for the same purposes. The thus erected structure is remarkable by the quality of the joints and by the ease and quickness of its assembly or disassembly.

DePIERI, BRUNO DePIERI, MASSIMO, DePIERI, CEASRE

BUILDING BLOCK

U.S. Pat. No. 5,471,808

The building block has a hollow body with lateral surfaces which bear a decorative finish, a flat upper surface having studs protruding therefrom, and a bottom opening defining seats for accommodating the upwardly protruding studs of an underlying block. A frog is formed in the flat upper surface for permitting the introduction of an adhesive medium between adjacent blocks. The block can be provided with a framework having an upper frame and legs for interposition between adjacent blocks.

DUECK, VERNON J.

RETAINING WALL BLOCK

U.S. Pat. No. 5,505,034

A block for forming a retaining wall comprising a generally parallelepiped body with front, rear, top, bottom and side surfaces and a central internal cavity with internal walls. Integrally formed protruding knobs are formed on the bottom surface adjacent the front surface and are positioned for protruding into the central cavity of at least one other block in a wall formed from the blocks. The protruding knobs are adapted to abut the internal walls of the open cavity to position the block in the retaining wall. A wall construction using the blocks is provided.

SUMMARY OF THE INVENTION

A primary object of the present invention is to provide an improved building block that will overcome the shortcomings of the prior art devices.

Another object is to provide an improved building block that is a much faster installation, with less skill necessary for constructing an exterior wall, since the building blocks will also be set with equally spaced joints therebetween by mating alignment projections and alignment sockets between the building blocks.

An additional object is to provide an improved building block in which the mason can stack more courses without settling and does not have to put a level on every building block during the construction of the exterior wall, since the lowest course of building blocks are leveled on a support foundation with adjustment feet.

A still additional object is to provide an improved building block, in which the motor can be applied later between the joints with a mortar gun, while the exterior wall is less likely to split and crack between the joints.

A further object is to provide an improved building block that is simple and easy to use.

A still further object is to provide an improved building block that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a top perspective view, showing a portion of an exterior wall incorporating the present invention.

FIG. 2 is a front elevational view taken in the direction of arrow 1 in FIG. 1, with parts broken away and in section.

FIG. 2*a* is an enlarged cross sectional view as indicated by arrow 2*a* in FIG. 2, showing one of the adjustment feet in greater detail.

Figure 3:
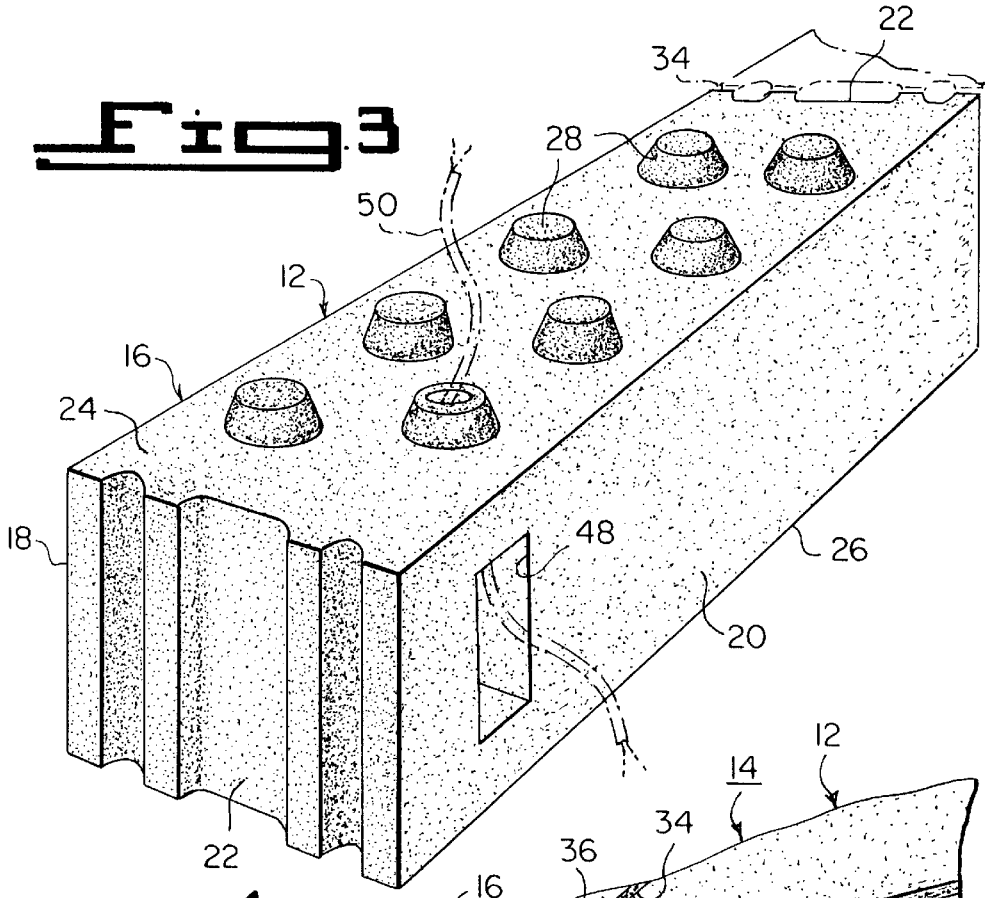

FIG. 3 is a top perspective view of one building block taken in the direction of arrow 3 in FIG. 1.

Figure 4:
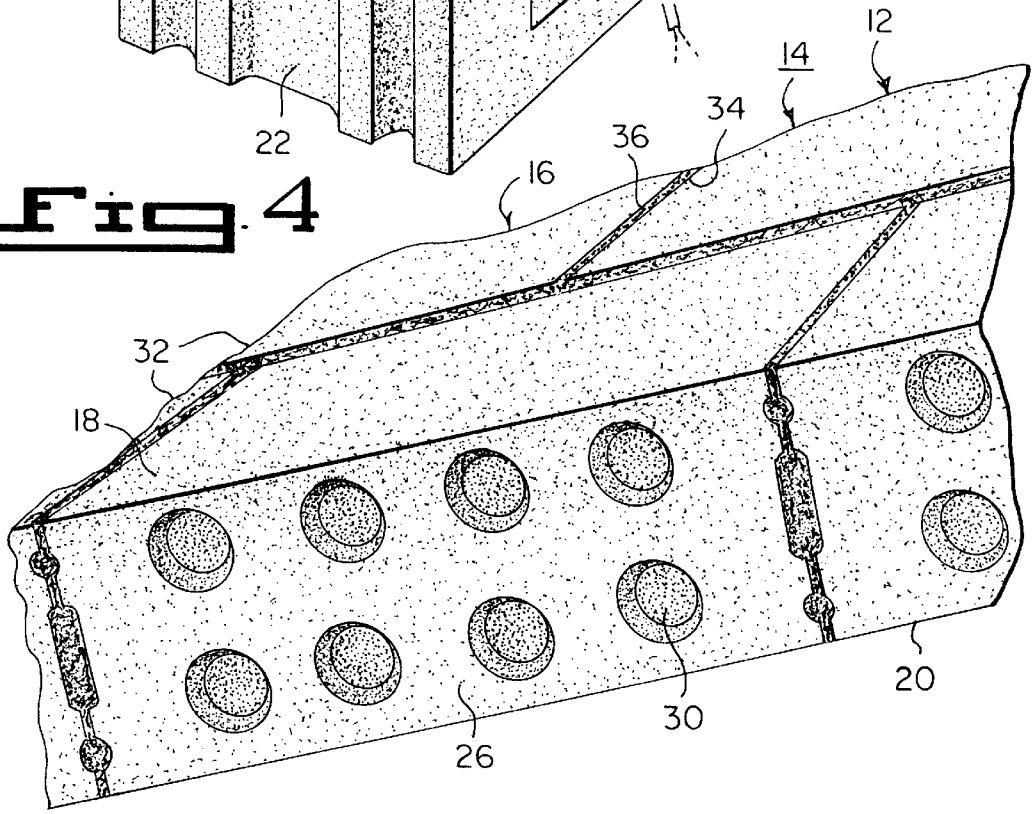

FIG. 4 is a bottom perspective view of a portion of two courses of the building blocks taken in the direction of arrow 4 in FIG. 1.

Figure 5:
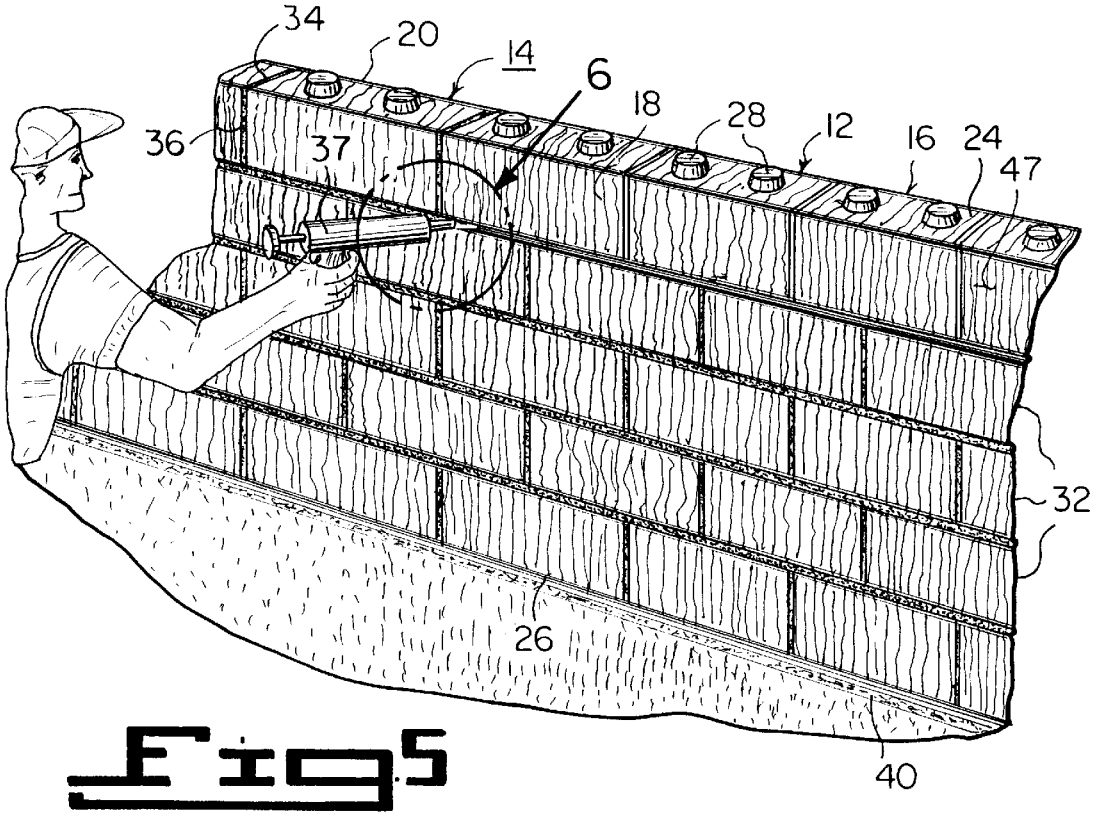

FIG. 5 is a top perspective view of the exterior wall, showing a mason applying mortar with a mortar gun between the joints of the building blocks.

Figure 6:
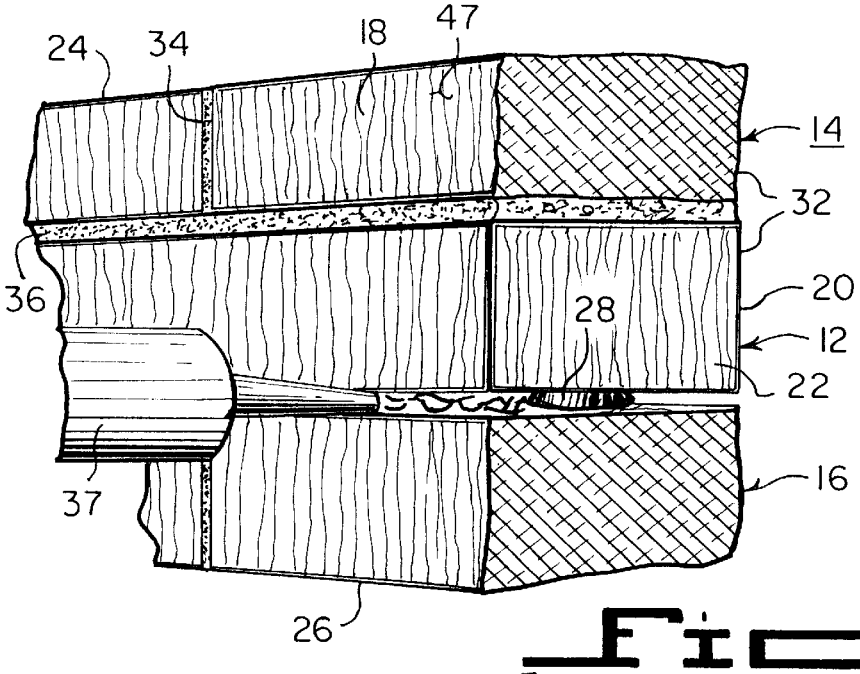

FIG. 6 is an enlarged perspective view of an area of FIG. 5 as indicated by arrow 6, showing the mortar gun applying the mortar between the joints of building blocks.

FIG. 7 is a top perspective view similar to FIG. 3 of a first modified building block, showing variant shaped projections thereon.

FIG. 8 is a side elevational view with parts broken away and in section of an exterior wall constructed by using the first modified building blocks.

FIG. 9 is a top perspective view of a portion of a second modified building block.

FIG. 10 is a cross sectional view taken along line 10—10 in FIG. 9.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 10 illustrate the present invention being an improved building block 12. With regard to the reference numerals used, the following numbering is used throughout the various drawing figures.

12 improved building block
14 exterior wall
16 solid body of 12
18 front face of 16
20 rear face of 16
22 end face of 16
24 top face of 16
26 bottom face of 16
28 alignment projection of 12 on 24
30 alignment socket of 12 in 26
32 course of 14
34 joint between 16
36 mortar for 34
37 mortar gun
38 leveling structure of 12 in 26
40 support foundation
42 adjustment foot of 38
44 female adapter
46 rounded corner between 18 and 22
47 decorative textured surface on 18
48 aligned opening in 20 with 28
50 electric line
52 concrete for 16
54 hollow cylinder in 16
56 transparent material for 16

The improved building block 12 is for constructing an exterior wall 14 and comprises a solid body 16 having a front face 18, a rear face 20, two end faces 22, a top face 24 and a bottom face 26. A plurality of alignment projections 28 are on the top face 24 of the solid body 16. The bottom face 26 of the solid body 16 has a plurality of alignment sockets 30 therein. When a plurality of the solid bodies 16 are laid side by side and are stacked offset one upon the other to make a plurality of courses 32, the alignment sockets 30 to form equally spaced joints 34 therebetween to be filled in later with mortar 36 from a mortar gun 37 as in FIGS. 5 and 6, to construct the exterior wall 14.

A structure 38 is for leveling each solid body 16 of the lowermost course 32, when the solid bodies 16 are laid upon a support foundation 40 during beginning of construction of the exterior wall 14. The solid bodies 16 of the other courses 32 will also be level when laid until the exterior wall 14 is completed. The leveling structure 38 includes a plurality of adjustment feet 42, each having a female adapter 44 embedded within the bottom face 26 of the solid body 16.

The solid body 16 is in a generally rectangular shape with the front face 18 and the rear face 20 longer in length than the end faces 22. Each alignment projection 28 is integral with the top face 24 of the solid body 16 and is tapered. Each alignment socket 30 in the bottom face 26 of the solid body 16 is tapered, but at a different angle than each alignment projection 28. When the alignment projections 28 are inserted within the alignment sockets 30, uniform spaces are formed therebetween to be filled in with the mortar 36.

The solid body 16 can include a rounded corner 46 between the front face 18 and one of the end faces 22, so that the solid body 16 can be laid at a corner of one of the course 32 of the exterior wall 14 (see FIGS. 1 and 2). The front face 18 of the solid body 16 can include a decorative textured surface 47 (see FIGS. 5 and 6).

At least one of the alignment projections 28 in FIG. 3 can be hollow. An aligned opening 48 can be made through the rear face 20 of the solid body 16, to allow an electric line 50 to be snaked therethrough. The solid body 16, as shown in FIG. 2*a*, is fabricated out of concrete 52.

As shown in FIGS. 1 through 6, each alignment projection 28 is in a frustum conical shape, while each alignment socket 30 is a frustum conical recess. In FIGS. 7 and 8, each alignment projection 28 is in a rectangular frustum pyramidal shape, while each alignment socket 30 is a rectangular frustum pyramidal recess.

The solid body 16 in FIGS. 9 and 10, includes a plurality of hollow cylinders 54 vertically imbedded therethrough. Each hollow cylinder 54 has one alignment projection 28 integral therewith and extending upwardly from the top face 24 of the solid body 16. One alignment socket 30 is integral therewith at the bottom face 26 of the solid body 16. The solid body 16 is fabricated out of a transparent material 56.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved building block for constructing an exterior wall comprising:

a) a solid body having a front face, a rear face, two end faces, a top face and a bottom face;

b) a plurality of alignment projections on said top face of said solid body; and c) said bottom face of said solid body having a plurality of alignment sockets therein, so that when a plurality of said solid bodies are laid side by side and are stacked offset one upon the other to make a plurality of courses, said alignment projections will engage with said alignment sockets to form equally spaced joints therebetween to be filled in later with mortar, to construct the exterior wall, and further including:

d) means for leveling each said solid body of the lowermost course, when said solid bodies are laid upon a support foundation during beginning of construction of the exterior wall, so that said solid bodies of the other courses will also be level when laid until the exterior wall is completed, said leveling means including a plurality of adjustment feet, each having a female adapter embedded within said bottom face of said solid body.

2. An improved building block as recited in claim 1, wherein said solid body is in a generally rectangular shape with said front face and said rear face longer in length than said end faces.

3. An improved building block as recited in claim 1, wherein each said alignment projection is integral with said top face of said solid body and is tapered.

4. An improved building block as recited in claim 3, wherein each said alignment socket in said bottom face of said solid body is tapered, but at a different angle than each said alignment projection, so that when said alignment projections are inserted within said alignment sockets uniform spaces are formed therebetween to be filled in with the mortar.

5. An improved building block as recited in claim 1, wherein said solid body includes a rounded corner between said front face and one of said end faces, so that said solid body can be laid at a corner of one of the courses of the exterior wall.

6. An improved building block as recited in claim 1, wherein said front face of said solid body includes a decorative textured surface.

7. An improved building block as recited in claim 1, wherein at least one of said alignment projections is hollow, so that an aligned opening can be made through said rear face of said solid body, to allow an electric line to be snaked therethrough.

8. An improved building block as recited in claim 1, wherein said solid body is fabricated out of concrete.

9. An improved building block as recited in claim 4, wherein each said alignment projection is in a frustum conical shape, while each said alignment socket is a frustum conical recess.

10. An improved building block as recited in claim 4, wherein each said alignment projection is in a rectangular frustum pyramidal shape, while each said alignment socket is a rectangular frustum pyramidal recess.

11. An improved building block as recited in claim 1, wherein said solid body includes a plurality of hollow cylinders vertically imbedded therethrough, in which each said hollow cylinder has one alignment projection integral therewith and extending upwardly from said top face of said solid body, and one alignment socket integral therewith at said bottom face of said solid body.

12. An improved building block as recited in claim 11, wherein said solid body is fabricated out of a transparent material.

13. An improved building block as recited in claim 2, wherein each said alignment projection is integral with said top face of said solid body and is tapered.

14. An improved building block as recited in claim 13, wherein each said alignment socket in said bottom face of said solid body is tapered, but at a different angle than each said alignment projection, so that when said alignment projections are inserted within said alignment sockets uniform spaces are formed therebetween to be filled in with the mortar.

15. An improved building block as recited in claim 14, wherein said solid body includes a rounded corner between said front face and one of said end faces, so that said solid body can be laid at a corner of one of the courses of the exterior wall.

16. An improved building block as recited in claim 15, wherein said front face of said solid body includes a decorative textured surface.

17. An improved building block as recited in claim 16, wherein at least one of said alignment projections is hollow, so that an aligned opening can be made through said rear face of said solid body, to allow an electric line to be snaked therethrough.

18. An improved building block as recited in claim 17, wherein said solid body is fabricated out of concrete.

19. An improved building block as recited in claim 18, wherein each said alignment projection is in a frustum conical shape, while each said alignment socket is a frustum conical recess.

20. An improved building block as recited in claim 18, wherein each said alignment projection is in a rectangular frustum pyramidal shape, while each said alignment socket is a rectangular frustum pyramidal recess.

21. An improved building block as recited in claim 2, wherein said solid body includes a plurality of hollow cylinders vertically imbedded therethrough, in which each said hollow cylinder has one alignment projection integral therewith and extending upwardly from said top face of said solid body, and one alignment socket integral therewith at said bottom face of said solid body.

22. An improved building block as recited in claim 21, wherein said solid body is fabricated out of a transparent material.

* * * * *